US006737947B1

(12) United States Patent
Volckmann et al.

(10) Patent No.: US 6,737,947 B1
(45) Date of Patent: May 18, 2004

(54) ASSEMBLY FOR SEALING ELECTRICAL LEADS TO INTERNAL ELECTRICAL DEVICE

(75) Inventors: Edward H. Volckmann, Morrison, IL (US); Kent Wegley, Morrison, IL (US)

(73) Assignee: Climco Coils Company, Morrison, IL (US)

( * ) Notice: Subject to any disclaimer, the term of this patent is extended or adjusted under 35 U.S.C. 154(b) by 206 days.

(21) Appl. No.: 09/683,061

(22) Filed: Nov. 14, 2001

Related U.S. Application Data

(60) Provisional application No. 60/255,359, filed on Dec. 13, 2000.

(51) Int. Cl.[7] ..... H01F 27/03

(52) U.S. Cl. ..... 336/90; 336/96; 336/107; 336/192

(58) Field of Search ..... 336/90, 92, 96, 336/107, 192; 174/152 G, 152 R, 65 G; 439/555, 567

(56) References Cited

U.S. PATENT DOCUMENTS

| | | | | | |
|---|---|---|---|---|---|
| 3,430,174 | A | | 2/1969 | Kogo et al. | |
| 4,299,374 | A | | 11/1981 | Yamanaka | |
| 4,492,421 | A | | 1/1985 | Ito | |
| 4,596,973 | A | * | 6/1986 | Form et al. | 336/96 |
| 4,632,487 | A | | 12/1986 | Wargula | |
| 4,683,454 | A | | 7/1987 | Vollmer et al. | |
| 4,849,728 | A | * | 7/1989 | Goll et al. | 336/92 |
| 4,901,395 | A | | 2/1990 | Semrau | |
| 5,047,744 | A | * | 9/1991 | Francis et al. | 336/58 |
| 5,220,301 | A | | 6/1993 | Haas et al. | |
| 5,307,038 | A | * | 4/1994 | Ishimaru | 335/296 |
| 5,710,535 | A | | 1/1998 | Goloff | |
| 6,010,134 | A | | 1/2000 | Katoh | |
| 6,069,316 | A | | 5/2000 | Utke | |
| 6,121,865 | A | | 9/2000 | Dust et al. | |
| 6,336,818 | B1 | * | 1/2002 | Bayer | 439/78 |

* cited by examiner

*Primary Examiner*—Tuyen T. Nguyen
(74) *Attorney, Agent, or Firm*—James C. Nemmers

(57) ABSTRACT

An electrical assembly that prevents contaminants from migrating to the coil windings within an encapsulant forming the main housing through the use of a sealing assembly located within an over-molded, thermoplastic encapsulant. Before over-molding, an elastomeric seal is installed on each lead wire to be sealed, and this wire/seal subassembly is then inserted into a seal housing made from the same basic thermoplastic as the encapsulant forming the housing. The seal housing has one or more continuous ribs, with sharp edges, that circumvent the outer surface of the seal housing. During over-molding to form the main housing, the molten encapsulant surrounds the seal housing and melts the tips of the ribs. Upon cooling, the (no thermoplastic solidifies and the encapsulant bonds to the seal housing along each of its ribs.

7 Claims, 3 Drawing Sheets

ASSEMBLY FOR SEALING ELECTRICAL LEADS TO INTERNAL ELECTRICAL DEVICE

BACKGROUND OF THE INVENTION

1. Field of the Invention

This invention relates to electrical assemblies and more particularly to solenoid and similar devices which have lead wires that connect internal components to an external junction outside the housing for the electrical device. Such electrical assemblies must have some means of preventing the ingress of moisture and other contaminants from migrating into the electrical device inside the housing.

2. Description of Related Art

Electrical devices, such as solenoid coils, will degrade and fail relatively quickly if the windings are exposed to moisture (rain, road salt, spray-down, submersion, etc.). These coils are often encapsulated in plastic for electrical isolation and this encapsulation affords the windings protection against direct water exposure as well. However, many solenoid coils have lead wires that run from the windings, through the plastic encapsulation, to the outside world creating an Indirect path for water ingress. This path exists because plastic encapsulants do not bond to lead wire insulation materials. Water (and aqueous solutions and mixtures) wicks into and moves along the interface between the lead wire insulation and the encapsulant to the windings, ultimately producing failure.

In U.S. Pat. No. 5,710,535, Goloff describes the use of elastomeric seals installed on each lead that are encapsulated along with the windings. The encapsulant, which is introduced around the coil assembly under significant pressure to form the housing, directly compresses the seal around each lead such that there is interference between the lead and the seal as well as between the encapsulant and the seal. However, a bond does not develop between the seal and the encapsulant and the dynamics of the molding process can distort the elastomer jeopardizing the soundness of the seal.

In U.S. Pat. No. 6,121,865, Dust et al. describe the use of an elastomeric seal that is installed around the leads after the coil has been encapsulated. In this method, the encapsulation mold is designed to produce a cavity around the leads where they exit the encapsulant forming the housing. The cavity formed in the encapsulant is sized to receive and compress the seal around the leads such that contaminants cannot penetrate the interface between the leads and the seal. The interface between the seal and the receiving cavity molded within the encapsulant is also under compression such that contaminants cannot penetrate this interface. However, some electrical assemblies, such as solenoids, cannot always accommodate pockets and seals where the leads exit the encapsulant forming the housing.

The Invention disclosed herein addresses the problem of contaminant ingress along leads in a practical way.

SUMMARY OF THE INVENTION

This invention prevents contaminants from migrating to the coil windings within an encapsulant forming the main housing through the use of a sealing assembly located within an over-molded, thermoplastic encapsulant. The seal assembly surrounds the insulated lead wires that extend from the coil windings either to outside the coil or to terminals that are molded into the free surface of the encapsulated coil. Before over-molding, an elastomeric seal is installed on each lead wire to be sealed, and this wire/seal subassembly is then inserted into a seal housing made from the same basic thermoplastic as the encapsulant forming the housing. The seal housing is constructed such that one or more continuous ribs, with sharp edges, circumvent the outer surface of the seal housing. During over-molding to form the main housing, the molten encapsulant surrounds the seal housing and melts the tips of the ribs. Upon cooling, the thermoplastic solidifies and the encapsulant bonds to the seal housing along each of its ribs.

DETAILED DESCRIPTION

Figure 1:
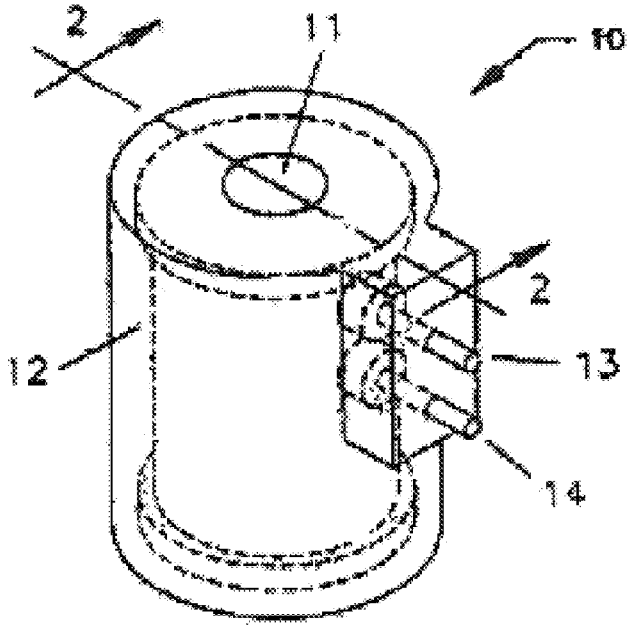
FIG. 1 is an perspective view of a solenoid-coil assembly showing an embodiment of the invention.

Referring now to FIG. 1, an electrical assembly 10, such as a solenoid coil assembly, is depicted with a passageway 11 typically extending through the full length of assembly 10. As is described hereinafter, the assembly 10 is over-molded with a thermoplastic encapsulant to form a main housing 12. Insulated electrical leads 13 and 14 protrude from housing 12 so that electrical connections can be made outside of the assembly 10.

Although the following description is for seal housing 17 and lead wire 13, it will be understood that the same construction is applied to seal housing 18 and lead wire 14.

Figure 2:
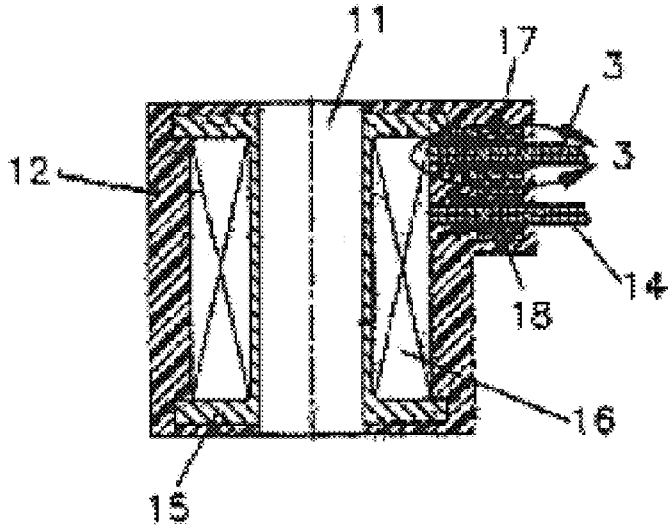
FIG. 2 is a cross—sectional view taken along line 2—2 of FIG. 1.

As best illustrated in FIG. 2, magnet wire is wound around a bobbin 15 to produce coil windings 16. Lead wires 13 and 14 connect the start and end of the windings 16 to points outside of assembly 10. Lead 13 passes through a seal housing indicated generally by the reference numeral 17 while lead 14 passes through a seal housing indicated generally by the reference numeral 18.

Figure 3:
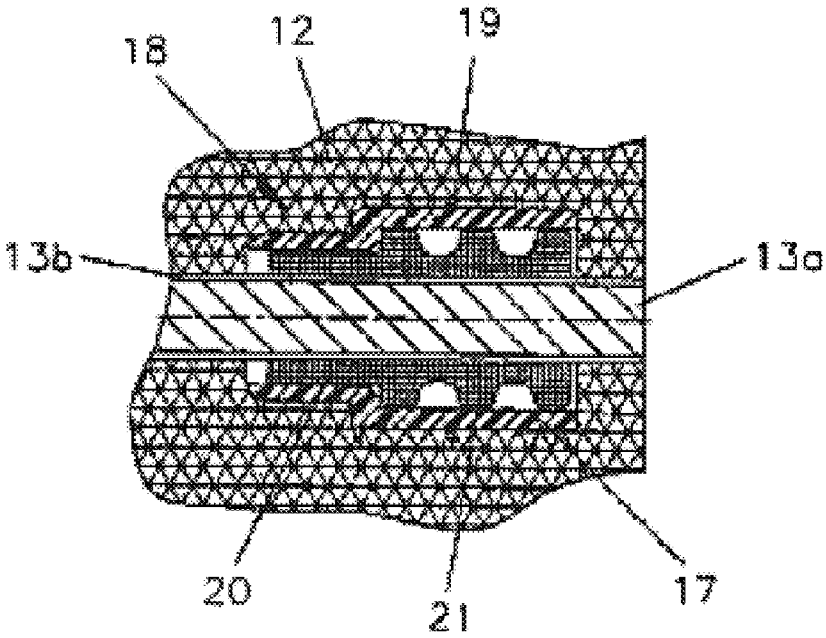
FIG. 3 is an enlarged view of a portion of FIG. 2 as defined by line 3—3 of FIG. 2.
Figure 6:
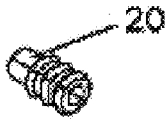
FIG. 6 is a perspective view of the elastomeric seal.
Figure 7:
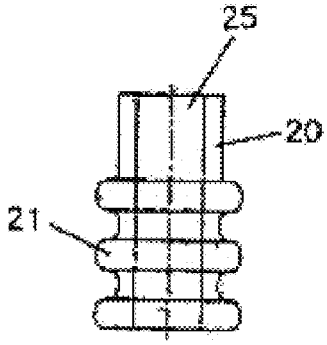
FIG. 7 is a plan view of the elastomeric seal shown in FIG. 6.

FIG. 3 is an enlarged view of a portion of the main housing 12 taken along line 3—3 of FIG. 2 and shows lead wire 13 is comprised of a conductor 13*a* jacketed with electrical insulation 13*b*. The lead wire 13 passes through an elastomeric seal 20. As shown, seal 20 will accommodate lead wire 13 but it will be understood that a modified seal may have two or more passages to accommodate two or more lead wires as illustrated in the embodiment shown in FIGS. 8 and 9. As shown in FIGS. 3 and 7, it will be understood that the inside diameter 25 of seal 20 is smaller than the outside diameter of lead wire 13 to produce an interference fit. Also, as seen in FIGS. 3, 6 and 7, elastomeric seal 20 has circumferential ribs 21 extending outwardly from its outer surface, the outside diameter of ribs 21 being greater than the inside diameter of the seal housing 17 segment 22 into which the ribs 21 are seated as described hereinafter.

Figure 5:
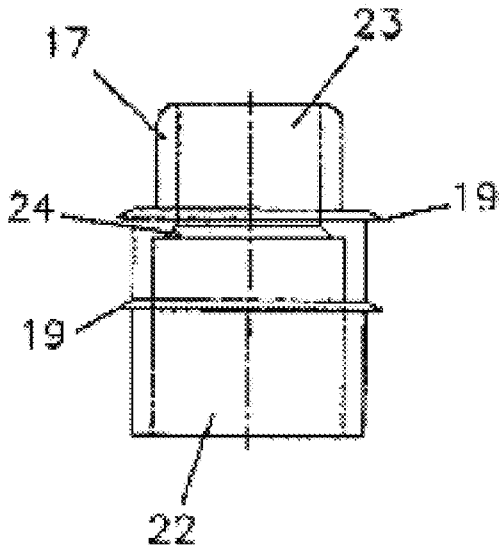
FIG. 5 is a plan view of the seal housing shown in FIG. 4.

As shown in FIG. 5, the seal housing 17 has a first segment 22 having a diameter that produces an interference fit with elastomeric seal ribs 21, a diametrical transition segment 24 and a smaller diameter inner segment 23 sufficient in diameter to accommodate the non-ribbed portion of seal 20. Therefore, when seal 20, containing lead wire 13, is inserted into the seal housing 17, it will be understood that an interference fit will be created by ribs 21 to provide a positive seal with the first interior segment 22.

Figure 4:
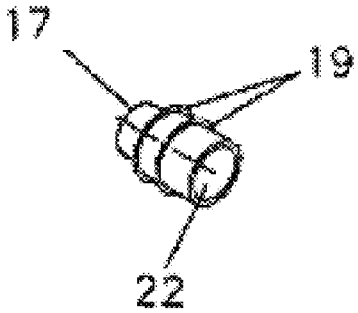
FIG. 4 is a perspective view of the seal housing portion of the assembly.

Seal housing 17 also is formed with one or more continuous ribs 19 (FIG. 4) that circumvent the exterior of the seal housing 17. Each rib 19 is shaped to have low-mass extremities such that the ribs 19 will be partially melted by the molten encapsulant forming the housing 12 during over-molding.

Figure 8:
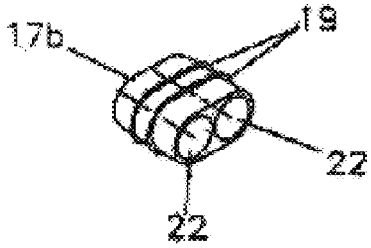
FIG. 8 is a perspective view of another embodiment of the seal housing.
Figure 9:
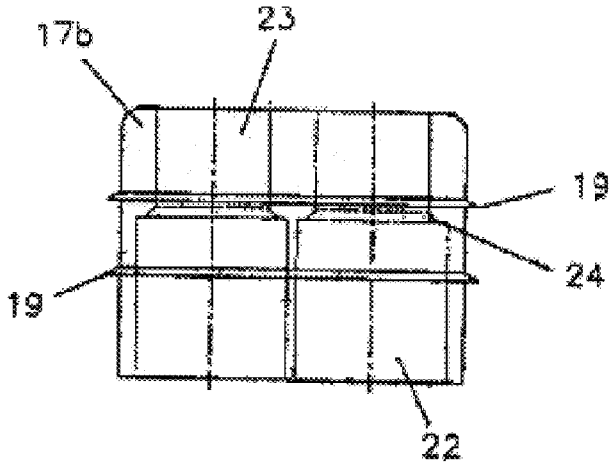
FIG. 9 is a plan view of the seal housing shown in FIG. 8.

The seal housings 17 and 18 may each be designed to accommodate a single lead 13 or 14 as described above, but it should be understood that two leads 13 and 14, each with a seal 20, may be incorporated into a single seal housing 17*b* as shown in FIGS. 8 and 9. In this embodiment, the interior construction and dimensions are the same as each individual housing 17 and 18 so as to accommodate both leads 13 and 14 each with a seal 20.

In manufacturing the electrical assembly of the invention, care must be taken in the selection of component materials. To achieve proper compressive sealing, the seals 20 are preferably made from an elastomer. The elastomer must be able to withstand elevated molding temperatures and not adversely react with the seal housings 17 or 18 or the encapsulant used in forming the main housing 12. Silicone rubber is satisfactory for these purposes and commercially available seals, such as those used in connectors manufactured by Delphi Automotive Systems, can be used. Individual seals may be used for each lead wire or a single seal could have multiple passages to accommodate multiple lead wires.

Both thermoset and thermoplastics are commonly used to over-mold electrical assemblies such as solenoid coils. However, in this invention, the over-molding encapsulant forming the main housing must be a thermoplastic polymer. In addition, to accomplish bonding between the encapsulant and the ribs 19 of the seal housings 17 and 18, each seal housing must be made from the same basic thermoplastic resin as the encapsulant. For instance, if the encapsulating plastic is a polyamide, the seal housings 17 and 18 should also be made from a polyamide. However, the nature and amount of fillers in the polymer (e.g., glass fibers) may differ between the encapsulant forming the main housing 12 and the seal housings 17 and 18 without adversely impacting bonding along the seal housing ribs 19. Other thermoplastic resins that work well for this application include, but are not limited to, polyethylene terephthalate and high temperature nylon (available from DuPont Engineering Polymers).

After the coil of the electrical assembly is wound, the lead wires 13 and 14, with an electrically insulating covering, are joined to the start and finish ends of the windings that form the coil. The free end of each of lead wire 13 and 14 is then forced through the elastomeric seal 20 and through the seal housing 17 or 18. Next, each seal 20 is moved along the lead wire 13 and 14 until seated in the seal housing 17 or 18 with the seal housing positioned along its lead wire as desired such that it will be properly located within the encapsulant after over-molding to form the main housing 12. This subassembly is then positioned in a mold of the desired size and configuration for the main housing 12, and the subassembly is subsequently encapsulated with a thermoplastic polymer of the same type as the seal housing 20.

When the electrical assembly of the invention is placed in service, any contaminants in the environment where the assembly is used will be drawn into the coil inside the main housing 12 along the lead wires 13 and 14 until reaching the seal assembly. There the elastomeric seals 20 will prevent further ingress along the interface between the seals 20 and the insulation 13*b* of the lead wire 13 (as well as the insulation around lead wire 14). The bond created between the encapsulant forming the main housing 12 and the ribs 21 of the seal housings 20 prevent ingress around the seal housings. Contaminants are thereby blocked from migrating along the lead wires to the electrical windings inside the housing 12.

Other aspects, objects and advantages of this invention can be obtained from a study of the drawings and the disclosure. This description is intended to only provide a complete description of the preferred embodiments of the present invention and does not in any way limit the scope of the invention. Having thus described the invention in connection with the preferred embodiments thereof, it will be evident to those skilled in the art that various revisions can be made to the preferred embodiments described herein without departing from the spirit and scope of the invention. It is our intention, however, that all such revisions and modifications that are evident to those skilled in the art will be included within the scope of the following claims.

What is claimed is:

1. An electrical assembly having lead wires for connection to an external junction, said assembly comprising:

a main housing formed from an encapsulant by over molding, the main housing having an opening therein that extends outside the main housing;

an electrical device enclosed by the main housing;

a lead wire connected to the electrical device and extending through the opening and outside the main housing;

a seal housing extending around the opening in the main housing and having an opening therein through which the lead wire extends;

a seal adapted to surround the lead wire and provide a seal around the lead wire, the seal having ribs extending outwardly from the outer surface of the seal to form an interference fit inside the opening of the seal housing;

and ribs extending outwardly from the seal housing and adapted to bond with the main housing; the ribs being of the same material as the main housing so as to melt and form a bond with the main housing during the over molding that forms the main housing.

2. The electrical assembly of claim 1 in which the seal housing is comprised of an inner segment and an outer segment, the opening in the outer segment being larger than the opening in the inner segment to form a shoulder between the segments, and the ribs on the seal provide an interference fit in the opening of the outer segment with one of the ribs abutting the shoulder.

3. The electrical assembly of claim 1 in which the seal is formed from an elastomer.

4. The electrical assembly of claim 3 in which the main housing and the seal housing are formed of a thermoplastic material.

5. The electrical assembly of claim 4 in which the ribs on the seal housing are shaped to have low mass extremities so that they will be melted by the encapsulant forming the main housing during the over-molding that forms the main housing.

6. The electrical assembly of claim 2 in which in which the seal is formed from an elastomer.

7. The electrical assembly of claim 6 in which the main housing and the seal housing are formed of a thermoplastic material.

* * * * *